US010139750B2

(12) United States Patent
Jang et al.

(10) Patent No.: US 10,139,750 B2
(45) Date of Patent: Nov. 27, 2018

(54) DEVELOPING CARTRIDGE, DEVELOPING APPARATUS AND IMAGE FORMING APPARATUS HAVING THE SAME

(71) Applicant: S-PRINTING SOLUTION CO., LTD., Suwon-si, Gyeonggi-do (KR)

(72) Inventors: Ho-jin Jang, Suwon-si (KR); Jong-in Kim, Suwon-si (KR); Seong-woong Yang, Suwon-si (KR); Woong-yong Choi, Yongin-si (KR); Jin-hwa Hong, Suwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/647,890

(22) Filed: Jul. 12, 2017

(65) Prior Publication Data

US 2018/0181023 A1 Jun. 28, 2018

(30) Foreign Application Priority Data

Dec. 28, 2016 (KR) ..... 10-2016-0180828

(51) Int. Cl.
*G03G 15/08* (2006.01)
*G03G 15/00* (2006.01)

(52) U.S. Cl.
CPC ..... *G03G 15/0836* (2013.01); *G03G 15/0834* (2013.01); *G03G 15/0841* (2013.01); *G03G 15/0889* (2013.01); *G03G 15/5008* (2013.01); *G03G 2215/0668* (2013.01); *G03G 2215/0869* (2013.01)

(58) Field of Classification Search
CPC ..... G03G 15/0834; G03G 15/0836; G03G 15/0889; G03G 2215/0668; G03G 2215/0869
See application file for complete search history.

(56) References Cited

U.S. PATENT DOCUMENTS

| | | | | |
|---|---|---|---|---|
| 5,943,538 | A | 8/1999 | Choi | |
| 6,782,221 | B2 | 8/2004 | Saito et al. | |
| 8,712,294 | B2 | 4/2014 | Koyama et al. | |
| 2005/0117920 | A1* | 6/2005 | Ogata | G03G 15/0856 399/27 |
| 2007/0048019 | A1 | 3/2007 | Kim et al. | |
| 2010/0166465 | A1 | 7/2010 | Mase | |
| 2015/0261134 | A1* | 9/2015 | Kikuchi | G03G 15/0889 399/254 |

FOREIGN PATENT DOCUMENTS

| | | |
|---|---|---|
| EP | 1031893 | 8/2000 |
| EP | 2320278 | 5/2011 |

(Continued)

*Primary Examiner* — Sandra Brase
(74) *Attorney, Agent, or Firm* — Staas & Halsey LLP

(57) ABSTRACT

A developing cartridge is disposed in an image forming apparatus. The developing cartridge includes a developing portion; a toner storing portion; a partition wall positioned between the developing portion and the toner storing portion and provided with a toner supply section; a first agitating member inside the developing portion; and a second agitating member inside the toner storing portion, wherein at least one of the first agitating member and the second agitating member comprises an elastic member to be in contact with the partition wall.

20 Claims, 26 Drawing Sheets

(56) References Cited

FOREIGN PATENT DOCUMENTS

| | | |
|---|---|---|
| EP | 2653932 | 10/2013 |
| JP | 2004-317846 | 11/2004 |
| JP | 2009-157345 | 7/2009 |
| JP | 2010-217225 | 9/2010 |
| JP | 5610968 | 10/2014 |
| KR | 10-0614068 | 8/2006 |

* cited by examiner

--Related Art--

DEVELOPING CARTRIDGE, DEVELOPING APPARATUS AND IMAGE FORMING APPARATUS HAVING THE SAME

CROSS-REFERENCE TO RELATED APPLICATIONS

This application claims priority from Korean Patent Application No. 10-2016-0180828 filed Dec. 28, 2016 in the Korean Intellectual Property Office, the disclosure of which is incorporated herein by reference in its entirety.

BACKGROUND

1. Field

The present disclosure relates to a developing cartridge including a developing roller. More particularly, the present disclosure relates to a developing cartridge including a plurality of agitating members for agitating toner to be supplied to a developing roller.

2. Description of the Related Art

An image forming apparatus using an electrophotographic method forms a visible toner image on an image carrier by supplying toner to an electrostatic latent image formed on the image carrier, transfers the toner image onto a print medium, and fixes the transferred toner image on the print medium, thereby printing a predetermined image on the print medium.

A developing apparatus is to form a visible toner image on the image carrier, and may include an image carrier, a developing roller for supplying toner to the image carrier and a toner storing portion for receiving the toner. Such a developing apparatus may be formed in a variety of structures such as a monolithic structure in which the image carrier, the developing roller, and the toner storing portion are integrally formed, a separable structure in which the image carrier, the developing roller, and the toner storing portion are separated into at least two units, and the like.

FIG. 1 is a view illustrating a conventional developing apparatus.

Referring to FIG. 1, a conventional developing apparatus 300 includes an image carrier cartridge 310 in which an image carrier 311 is disposed and a developing cartridge 320 in which a developing roller 321 is disposed and toner is received.

The image carrier cartridge 310 includes the image carrier 311 which is rotatably disposed in the image carrier cartridge 310 and a waste toner receiving portion 313 for receiving waste toner.

The developing cartridge 320 includes a developing portion 323 including a developing roller 321 and a supply roller 322, and a toner storing portion 327 including an agitating member 325 and accommodating toner.

The developing roller 321 is rotatably disposed in the developing portion 327 and supplies the toner to the image carrier 311 provided in the image carrier cartridge 310. The supply roller 322 is rotatably disposed on one side of the developing roller 321. A first agitating member 324 is provided above the supply roller 322.

The toner storing portion 327 is provided above the developing portion 323 and supplies the toner to the developing portion 323. A second agitating member 325 is rotatably disposed at the center of the toner storing portion 327. When the second agitating member 325 rotates, one end portion 326 of the second agitating member 325 rotates while contacting almost all the inner wall of the toner storing portion 327. When the second agitating member 325 provided in the toner storing portion 327 rotates, the toner in the toner storing portion 327 is agitated and supplied to the developing portion 323.

The first agitating member 324 provided in the developing portion 323 is formed in an auger shape and supplies fresh toner supplied from the toner storing portion 327 toward the supply roller 322, and carries old toner toward the toner storing portion 327 so that the old toner remaining after development is not stagnated.

In the conventional developing cartridge 320, since the rotation radius of the second agitating member 325 located at the center of the toner storing portion 327 is large, when the second agitating member 325 rotates, the toner in the upper side of the toner storing portion 327 and the toner in the lower side of the toner storing portion 327 are continuously mixed with each other. Therefore, the toner accommodated in the toner storing portion 327 is continuously subjected to physical stress by the second agitating member 325.

Also, since the first agitating member 324 provided inside the developing portion 323 moves the old toner around the supply roller 322 to the toner storing portion 327, the fresh toner and the old toner are mixed in the developing portion 323 and the toner storing portion 327 as whole. Accordingly, since the fresh toner in the toner storing portion 327 is mixed with the old toner recovered from the developing portion 323 to the toner storing portion 327 while being continuously subjected to stress by the second agitating member 325, the life of the toner is reduced. In addition, when an image is formed with stressed toner, an image problem may be caused.

As described above, the conventional developing cartridge is difficult to use in an image forming apparatus requiring a long life because the toner accommodated in the toner storing portion is subjected to a lot of stress.

SUMMARY

The present disclosure has been developed in order to overcome the above drawbacks and other problems associated with the conventional arrangement. An aspect of the present disclosure relates to a developing cartridge which improves an agitation structure and supply structure of toner to minimize stress applied to the toner and to increase life of the toner, and a developing apparatus and an image forming apparatus having the same.

According to an aspect of the present disclosure, a developing cartridge that is disposed in an image forming apparatus, the developing cartridge may include a developing portion; a toner storing portion; a partition wall positioned between the developing portion and the toner storing portion and provided with a toner supply section; a first agitating member inside the developing portion; and a second agitating member inside the toner storing portion, wherein at least one of the first agitating member and the second agitating member comprises an elastic member to be in contact with the partition wall.

When the second agitating member including the elastic member rotates, the elastic member may be intermittently in contact with the partition wall and may be not in contact with an inner surface of the toner storing portion.

The second agitating member may include a rotation member and an elastic film attached to the rotation member, and wherein the elastic film is in contact with an upper surface of the partition wall and moves toner to the toner supply section by an elastic restoring force generated when the elastic film is separated from the partition wall.

The first agitating member may be disposed below the partition wall, and a rotation center of the first agitating member may be spaced apart from vertical extension lines of opposite ends of the toner supply section.

The first agitating member may include a rotation member and at least one elastic film attached to the rotation member, and the at least one elastic film may be provided to be in contact with a lower surface of the partition wall when the first agitating member rotates.

The at least one elastic film of the first agitating member may include a first elastic film and a second elastic film disposed at an interval of substantially 90 degrees on the rotation member.

The developing cartridge may include a developing roller rotatably disposed in the developing portion; and a supply roller disposed at one side of the developing roller, the supply roller configured to supply toner supplied from the toner storing portion to the developing roller, wherein a rotation center of the first agitating member is positioned between a rotation center of the developing roller and a rotation center of the supply roller.

The developing cartridge may include a cartridge driver which is provided in one side surface of the developing cartridge and is configured to receive power from an outside; a first supply roller driver which is provided at a first end of the supply roller and is rotated by a driving force transmitted from the cartridge driver; a second supply roller driver provided at a second end opposite to the first end of the supply roller; a first agitating member driver which is provided at one end of the first agitating member and receives the driving force from the second supply roller driver; and a second agitating member driver which is provided at one end of the second agitating member and receives the driving force from the first agitating member driver, wherein the second supply roller driver, the first agitating member driver, and the second agitating member driver are positioned on an opposite side surface to a side surface of the developing cartridge on which the cartridge driver and the first supply roller driver are provided in a longitudinal direction of the developing cartridge.

According to another aspect of the present disclosure, a developing cartridge may include a developing portion in which a developing roller is rotatably disposed; a toner storing portion which is located above the developing portion and receives toner; a partition wall which is positioned between the developing portion and the toner storing portion and is provided with a toner supply section through which the toner moves from the toner storing portion to the developing portion; a first agitating member which is disposed inside the developing portion and agitates the toner supplied to the developing portion; and a second agitating member which is disposed inside the toner storing portion and agitates the toner stored in the toner storing portion, wherein the first agitating member is disposed below the partition wall, and a rotation center of the first agitating member is spaced apart from vertical extension lines of opposite ends of the toner supply section.

Other objects, advantages and salient features of the present disclosure will become apparent from the following detailed description, which, taken in conjunction with the annexed drawings, discloses preferred embodiments.

BRIEF DESCRIPTION OF THE DRAWINGS

These and/or other aspects and advantages of the present disclosure will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION OF THE EXEMPLARY EMBODIMENTS

Hereinafter, certain exemplary embodiments of the present disclosure will be described in detail with reference to the accompanying drawings.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

The terms "first", "second", etc. may be used to describe diverse components, but the components are not limited by the terms. The terms are only used to distinguish one component from the others.

The terms used in the present application are only used to describe the exemplary embodiments, but are not intended to limit the scope of the disclosure. The singular expression also includes the plural meaning as long as it does not differently mean in the context. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof In the exemplary embodiment of the present disclosure, a "module" or a "unit" performs at least one function or operation, and may be implemented with hardware, software, or a combination of hardware and software. In addition, a plurality of "modules" or a plurality of "units" may be integrated into at least one module except for a "module" or a "unit" which has to be implemented with specific hardware, and may be implemented with at least one processor (not shown).

Figure 1:
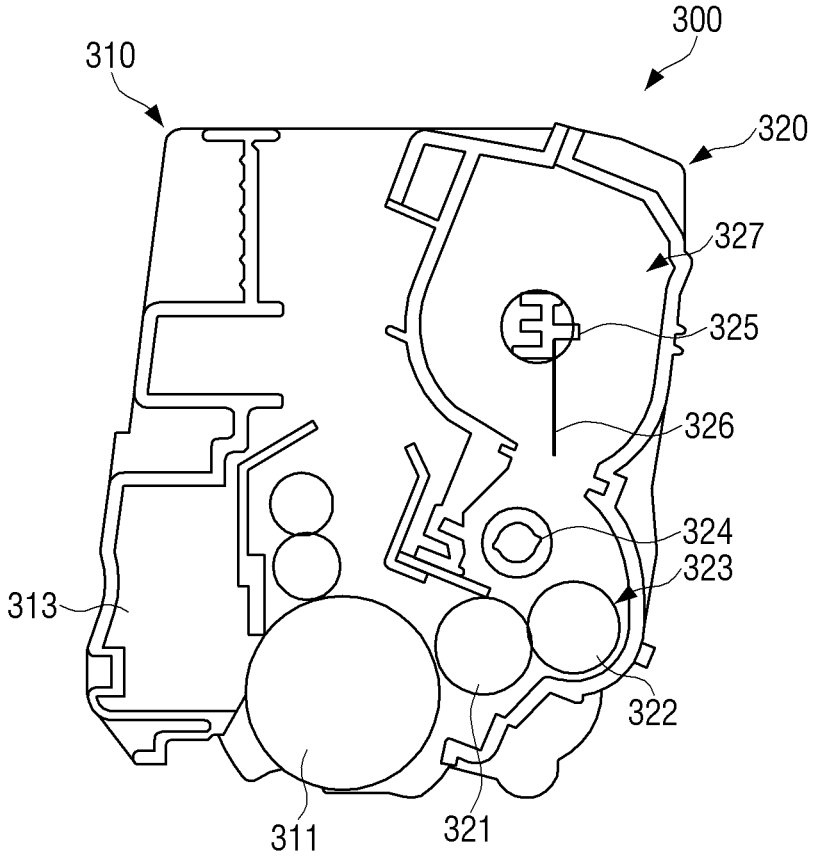
FIG. 1 is a cross-sectional view schematically illustrating a conventional developing apparatus.
Figure 2:
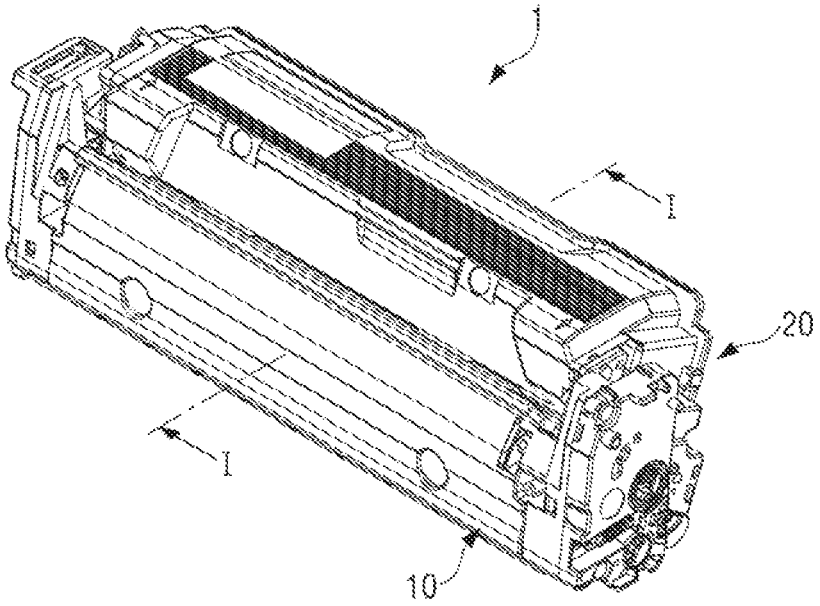
FIG. 2 is a perspective view illustrating a developing apparatus according to an embodiment of the present disclosure.
Figure 3:
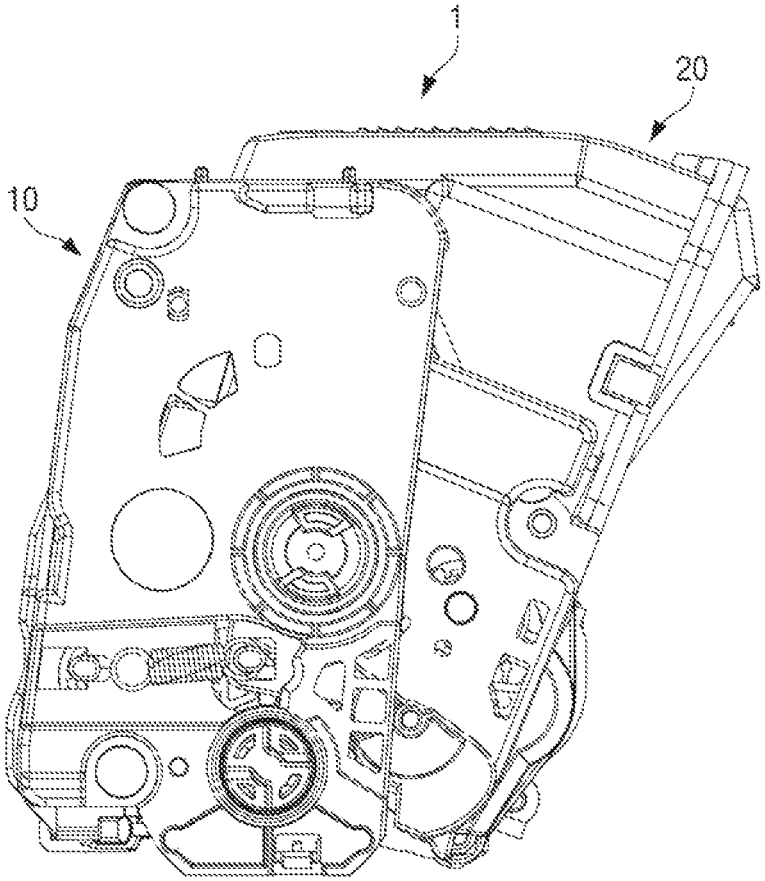
FIG. 3 is a side view illustrating a developing apparatus according to an embodiment of the present disclosure.
Figure 4:
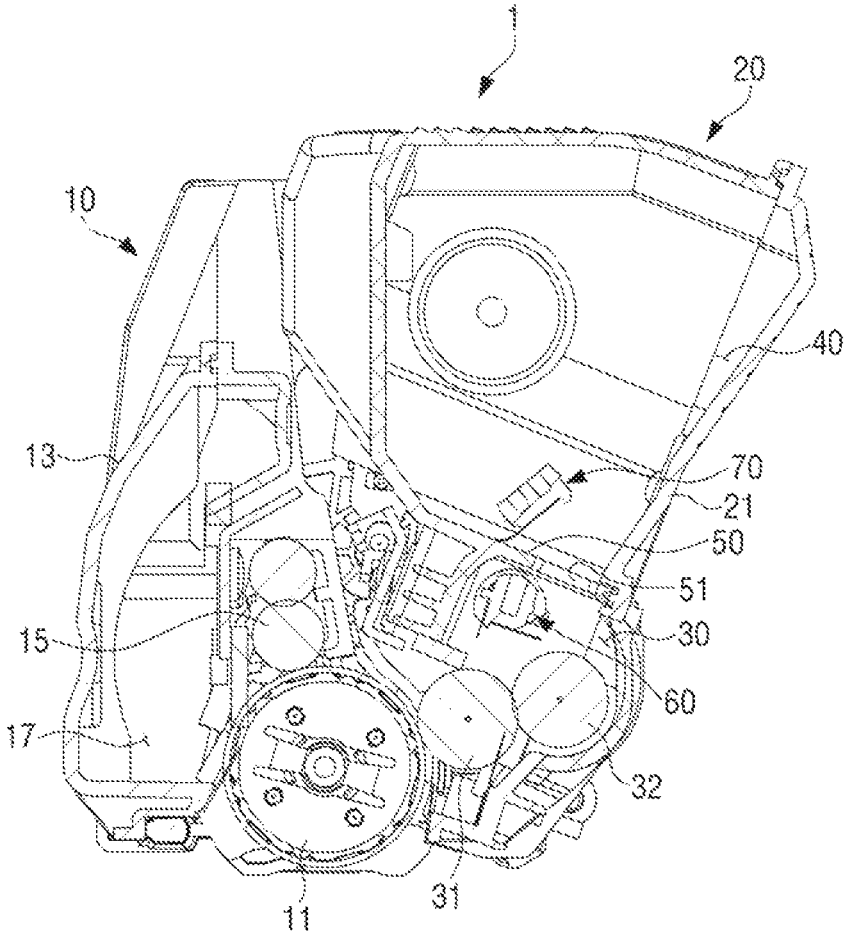
FIG. 4 is a cross-sectional view illustrating the developing apparatus of FIG. 2 taken along a line I-I.
Figure 5:
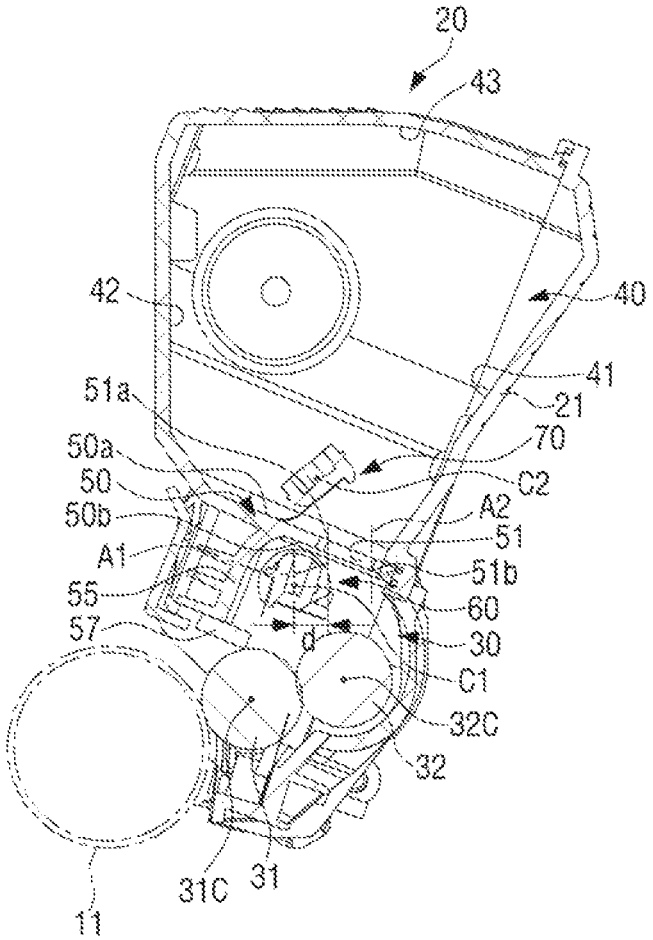
FIG. 5 is a cross-sectional view illustrating a developing cartridge according to an embodiment of the present disclosure.

FIG. 2 is a perspective view illustrating a developing apparatus according to an embodiment of the present disclosure. FIG. 3 is a side view illustrating a developing apparatus according to an embodiment of the present disclosure, and FIG. 4 is a cross-sectional view illustrating the developing apparatus of FIG. 2 taken along a line I-I . FIG. 5 is a cross-sectional view illustrating a developing cartridge according to an embodiment of the present disclosure.

Referring to FIGS. 2 to 4, a developing apparatus 1 according to an embodiment of the present disclosure may include an image carrier cartridge 10 and a developing cartridge 20.

The image carrier cartridge 10 may include an image carrier 11 and an image carrier housing 13 in which the image carrier 11 is rotatably disposed. An electrostatic latent image is formed on the image carrier 11 by light emitted from an exposure apparatus. The image carrier cartridge 10 is provided with a charging member 15 for charging the surface of the image carrier 11 at a predetermined voltage. In addition, the image carrier housing 13 is provided with a waste toner receiving portion 17 for receiving waste toner removed from the image carrier 11 after development.

The developing cartridge 20 is disposed on one side of the image carrier cartridge 10 and is configured to supply toner to the image carrier 11 so as to develop the electrostatic latent image into a toner image. The developing cartridge 20 may include a developing portion 30 and a toner storing portion 40. In the following description, the toner includes a developer that can develop an electrostatic latent image into a visible image like a one-component developer.

The developing portion 30 and the toner storing portion 40 are partitioned by a partition wall 50. The partition wall 50 is provided with a toner supply section 51 through which the toner in the toner storing portion 40 is supplied to the developing portion 30. The partition wall 50 serves as a toner blocking wall that blocks the toner in the toner storing portion 40 from moving to the developing portion 30 when a second agitating member 70 provided in the toner storing portion 40 does not operate. The partition wall 50 also serves as a toner conveying wall functioning as a toner conveying path that allows the toner in the toner storing portion 40 to move to the developing portion 30 when the second agitating member 70 in the toner storing portion 40 operates. When the second agitating member 70 operates, the toner in the toner storing portion 40 may be moved to the developing portion 30 through the toner supply section 51 of the partition wall 50.

Figure 6:
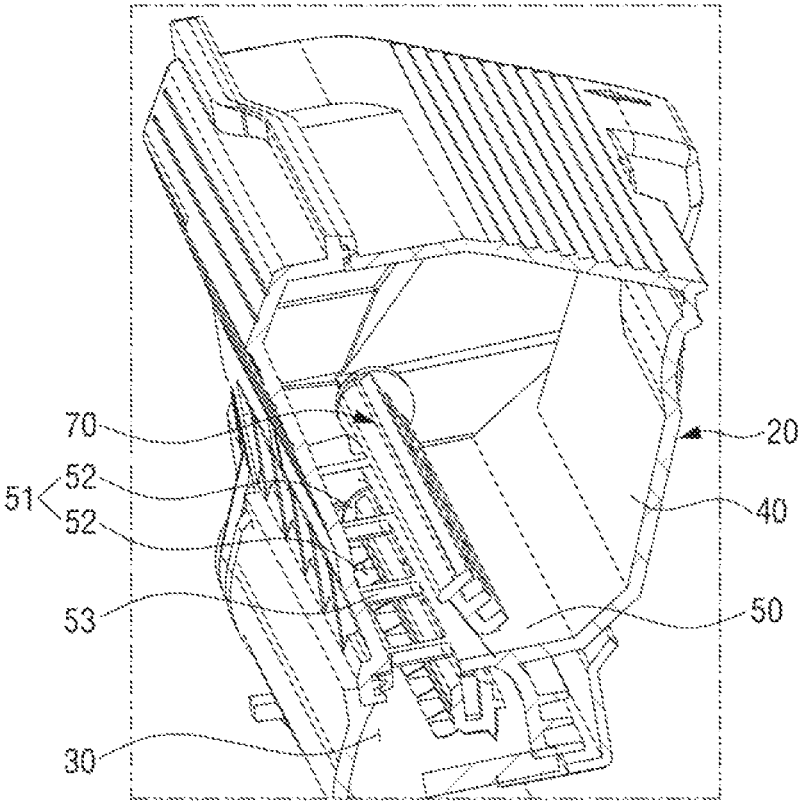
FIG. 6 is a partially cutaway perspective view illustrating a toner supply section of a developing cartridge according to an embodiment of the present disclosure.

The developing portion 30, the toner storing portion 40, and the partition wall 50 may be formed as a cartridge housing 21 having a single body. The toner supply section 51 may include a plurality of openings 52. For example, as illustrated in FIG. 6, the toner supply section 51 may be composed of the plurality of openings 52 that is partitioned by a plurality of ribs 53. At this time, the plurality of ribs 53 provided in the toner supply section 51 allows the developing cartridge 20 to maintain its strength. For reference, FIG. 6 is a partially cutaway perspective view illustrating a toner supply section of a developing cartridge according to an embodiment of the present disclosure.

Referring to FIGS. 4 and 5, the developing portion 30 is configured to supply the toner to the image carrier 11 and may include a developing roller 31, a supply roller 32, and a first agitating member 60.

The developing roller 31 is rotatably disposed in the developing portion 30 and supplies the toner to the image carrier 11. The supply roller 32 is provided on one side of the developing roller 31 in parallel to the developing roller 31 and is rotatably disposed with respect to the developing portion 30. The supply roller 32 supplies the toner to the developing roller 31.

The first agitating member 60 is rotatably disposed in the developing portion 30 and agitates the toner contained in the developing portion 30. The first agitating member 60 may be provided above the developing roller 31 and the supply roller 32. In detail, the first agitating member 60 may be disposed above a portion where the developing roller 31 and the supply roller 32 are in contact with each other. For example, the rotation center C1 of the first agitating member 60 may be positioned between the rotation center 31*c* of the developing roller 31 and the rotation center 32*c* of the supply roller 32. Also, the first agitating member 60 may be formed so that a part of the first agitating member 60, that is, one side surface in the longitudinal direction of the first agitating member 60 is in contact with a lower surface 50*b* of the partition wall 50 when the first agitating member 60 rotates. The first agitating member 60 may include an elastic member 65. In the case in which the first agitating member 60 includes the elastic member 65, when the first agitating member 60 rotates, a part of the elastic member 65 may be intermittently in contact with the lower surface 50*b* of the partition wall 50.

Figure 7:
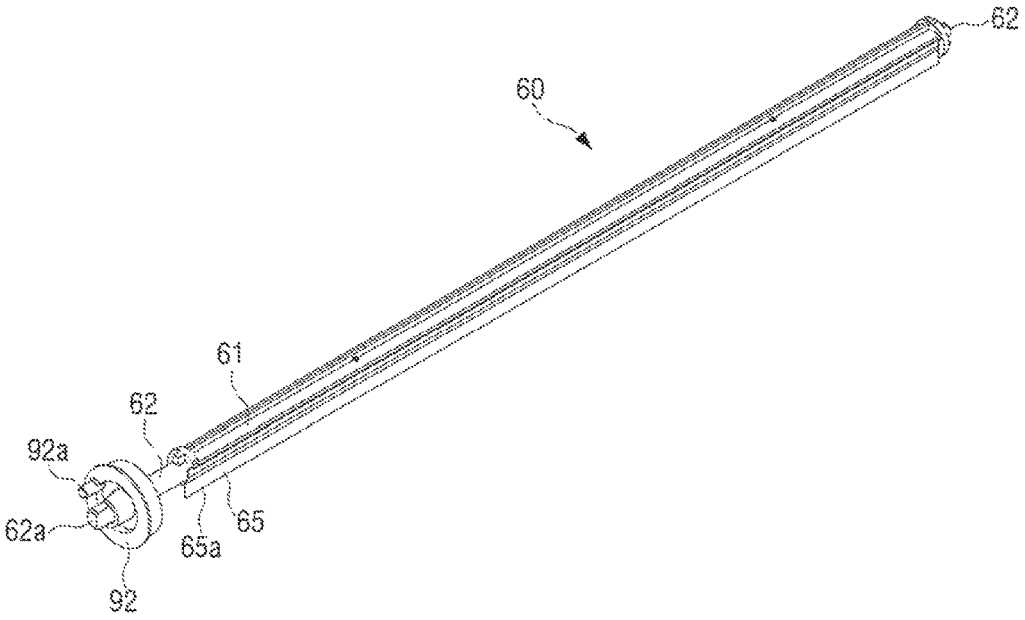
FIG. 7 is a perspective view illustrating a first agitating member used in a developing apparatus according to an embodiment of the present disclosure.

FIG. 7 is a perspective view illustrating a first agitating member used in a developing apparatus according to an embodiment of the present disclosure.

Referring to FIG. 7, the first agitating member 60 may include a rotation member 61 and the elastic member 65.

The rotation member 61 is formed of a rigid body and is rotated by power transmitted from the supply roller 32. Opposite ends of the rotation member 61 are provided with rotation shafts 62 so that the rotation member 61 is rotatably supported by opposite side walls of the developing portion 30.

The elastic member 65 is provided in one side surface of the rotation member 61 and may be formed of an elastic film. The elastic film 65 is attached to the one side surface of the rotation member 61. One side portion 65*a* of the elastic film 65 protrudes from the rotation member 61 and may come into contact with the lower surface 50*b* of the partition wall 50 when the rotation member 61 rotates. Therefore, when the rotation member 61 rotates, the protruding portion 65*a* of the elastic film 65 protruding from the rotation member 61 comes into contact with the lower surface 50*b* of the partition wall 50, and the elastic film 65 is bent. Accordingly, when the rotation member 61 makes one rotation, the elastic film 65 is bent while the elastic film 65 is in contact with the partition wall 50, and the elastic film 65 maintains its original flat state without bending deformation while the elastic film 65 is not in contact with the partition wall 50. The elastic film 65 may be formed in a thin flat plate shape with an elastic thin material.

Two or more elastic films 65 may be provided on the rotation member 61. When two elastic films 65 are provided on the rotation member 61, the protruding portions of the two elastic films 65 may be disposed to be approximately 90 degrees.

The lower surface 50*b* of the partition wall 50 may be provided with a blade supporting wall 55 extending downward, that is, toward the developing roller 31. A toner regulating member 57, for example, a doctor blade, which regulates the thickness of the toner attached to the developing roller 31 may be provided on the blade supporting wall 55. When the blade supporting wall 55 is provided on the lower surface 50*b* of the partition wall 50, the elastic film 65 of the first agitating member 60 provided between the partition wall 50 and the blade supporting wall 55 is formed to be able to contact both the blade supporting wall 55 and the partition wall 50. In this case, when the first agitating member 60 makes one rotation, the elastic film 65 agitates the toner in the developing portion 30 and supplies the toner to the supply roller 32 while passing through a section contacting with the blade supporting wall 55, a section contacting with the partition wall 50, and a non-contact section. Accordingly, the toner is not accumulated in the corner formed by the partition wall 50 and the blade supporting wall 55.

In addition, the first agitating member 60 may be disposed such that the rotation center C1 of the first agitating member 60 is located outside a projection area of the toner supply section 51 under the partition wall 50. For example, when the developing apparatus 1 including the developing cartridge 20 is provided and used in an image forming apparatus 100 (see FIG. 23), the first agitating member 60 may be disposed so that the rotation center C1 of the first agitating member 60 is not positioned in an area where the toner supply section 51 is projected in the gravity direction.

In FIG. 5, since the rotation center C1 of the first agitating member 60 is located on the left side of an imaginary plane in which the one side surface of the toner supply section 51 adjacent to the first agitating member 60 is extended in the gravity direction, the rotation center C1 of the first agitating member 60 is not located in the projected area of the toner supply section 51. In other words, as illustrated in FIG. 5, the first agitating member 60 may be provided so that the rotation center C1 of the first agitating member 60 is spaced apart from the vertical extension lines A1 and A2 in which the opposite ends 51*a* and 51*b* of the toner supply section 51 provided in the partition wall 50 are extended in the vertical direction. For example, the one end 51*a* of the toner supply section 51 adjacent to the first agitating member 60 may be spaced apart from the rotation center C1 of the first agitating member 60 by a predetermined distance d. Here, the opposite ends 51*a* and 51*b* of the toner supply section 51 refer to a upper edge 51*a* of one side surface of the toner supply section 51 substantially parallel to the first agitating member 60 and a lower edge 51*b* of the other side surface of the toner supply section 51 (see FIG. 5). Also, the vertical direction refers to the direction of gravity when the developing apparatus 1 including the developing cartridge 20 is mounted on the image forming apparatus 100 (see FIG. 23).

When the first agitating member 60 is provided as described above, the first agitating member 60 does not interfere with the toner moving from the toner storing portion 40 to the developing portion 30 through the toner supply section 51. In other words, the first agitating member 60 does not interfere with the toner supply from the toner storing portion 40 to the developing portion 30. Also, since an elastic force generated when the elastic film 65 of the first agitating member 60 comes into contact with and then is separated from the partition wall 50 may be applied to the toner supplied from the toner supply section 51, a toner flow may be made inside the developing portion 30. In addition, since the first agitating member 60 is located adjacent to the toner supply section 51 below the partition wall 50, the toner in the developing portion 30 may be prevented from moving to the toner storing portion 40 through the toner supply section 51.

Referring to FIGS. 4 and 5, the toner storing portion 40 is provided to receive the toner above the developing portion 30, and may include a second agitating member 70.

The partition wall 50 is provided on the lower side of the toner storing portion 40 and the toner supply section 51 communicated with the developing portion 30 is provided in the partition wall 50.

The inner space of the toner storing portion 40 may be formed in a substantially wedge shape such that the toner accommodated therein is sequentially moved toward the toner supply section 51 by gravity. In other words, the toner storing portion 40 may be formed in a substantially triangular structure having a wide upper portion and a narrow lower portion. At this time, the toner supply section 51 may be provided at a position corresponding to the lowermost end of the toner storing portion 40.

The second agitating member 70 is rotatably disposed inside the toner storing portion 40 and agitates the toner stored in the toner storing portion 40. Also, the second agitating member 70 supplies the toner stored in the toner storing portion 40 to the developing portion 30 through the toner supply section 51. The second agitating member 70 may include an elastic member 75. In the case in which the second agitating member 70 is provided with the elastic member 75, the elastic member 75 may be formed so that a part of the elastic member 75 comes into contact with only an upper surface 50*a* of the partition wall 50 and is not in contact with the other inner surfaces 41, 42, and 43 of the toner storing portion 40 when the second agitating member 70 rotates. The second agitating member 70 may be disposed so that the rotation center C2 is not located directly above the projection area of the toner supply section 51.

Figure 8:
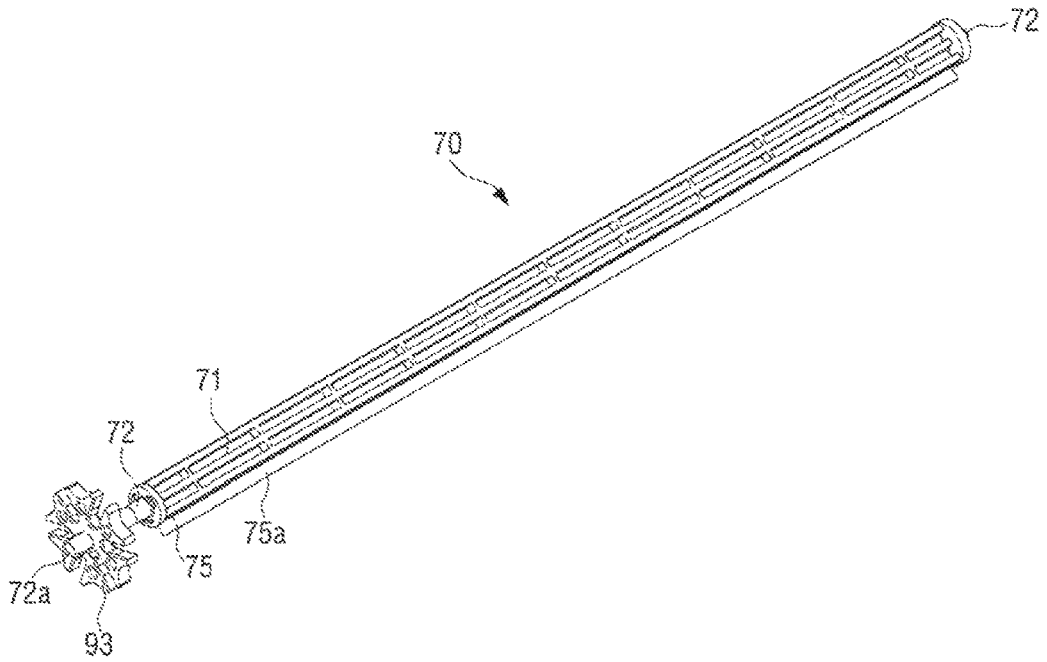
FIG. 8 is a perspective view illustrating a second agitating member used in a developing apparatus according to an embodiment of the present disclosure.

FIG. 8 is a perspective view illustrating a second agitating member used in a developing apparatus according to an embodiment of the present disclosure.

Referring to FIG. 8, the second agitating member 70 may include a rotation member 71 and the elastic member 75.

The rotation member 71 is formed of a rigid body and is rotated by power transmitted from the first agitating member 60. Opposite ends of the rotation member 71 are provided with rotation shafts 72 so that the rotation member 71 is rotatably supported by opposite side walls of the toner storing portion 40.

Figure 9:
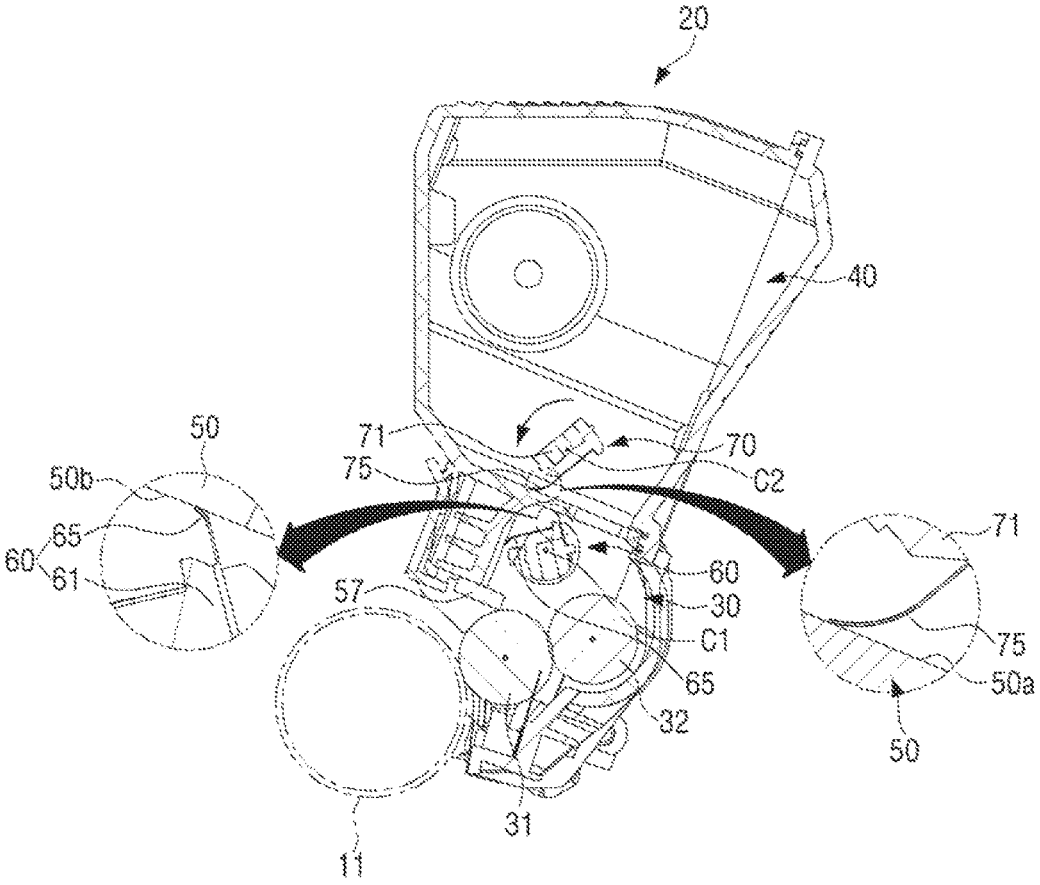
FIG. 9 is a view illustrating a state in which a first agitating member and a second agitating member of a developing cartridge according to an embodiment of the present disclosure are in contact with a partition wall.
Figure 10:
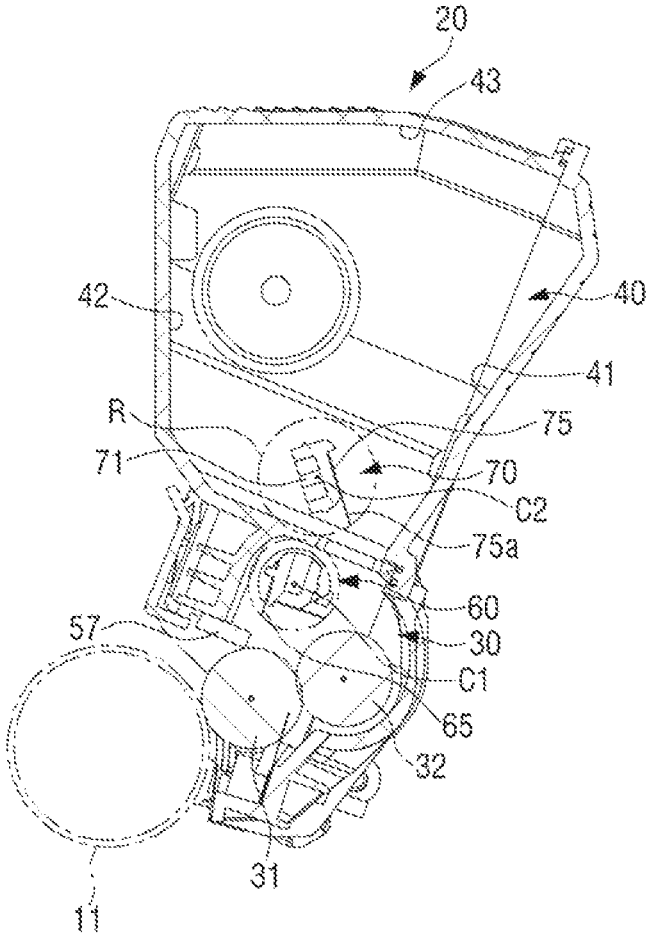
FIG. 10 is a view illustrating a state in which a first agitating member and a second agitating member of a developing cartridge according to an embodiment of the present disclosure are not in contact with a partition wall.

The elastic member 75 is provided in one side surface of the rotation member 71 and may be formed of an elastic film. The elastic film 75 is attached to one side surface of the rotation member 71. One side portion 75*a* of the elastic film 75 protrudes from the rotation member 71 and may come into contact with the upper surface 50*a* of the partition wall 50 when the rotation member 71 rotates. Therefore, when the rotation member 71 rotates, as illustrated in FIG. 9, the protruding portion 75*a* of the elastic film 75 protruding from the rotation member 71 comes into contact with the upper surface 50*a* of the partition wall 50, so that the elastic film 75 is bent. Accordingly, when the rotation member 71 makes one rotation, the elastic film 75 is bent, as illustrated in FIG. 9, while the elastic film 75 is in contact with the partition wall 50. The elastic film 75 maintains its original flat state without bending deformation, as illustrated in FIG. 10, while the elastic film 75 is not in contact with the partition wall 50. The elastic film 75 may be formed in a thin flat plate shape with an elastic thin material.

In addition, the protruding portion 75*a* of the elastic film 75 may be formed not to be in contact with the inner walls 41, 42, and 43 of the toner storing portion 40, for example, the right side wall 41, the left side wall 42, and the upper side wall 43 of the toner storing portion 40 as illustrated in FIG. 10. In other words, as illustrated in FIG. 10, since the rotation radius of the second agitating member 70 is small, the protruding portion 75*a* of the elastic film 75 is in contact with only the partition wall 50 and is not in contact with the other inner walls 41, 42, and 43 of the toner storing portion 40 (see the locus R of the leading end of the elastic film 65 in FIG. 10). To this end, the second agitating member 70 is disposed adjacent to the partition wall 50 at the lower side of the toner storing portion 40. For example, if the toner storing portion 40 is divided into upper and lower halves, the second agitating member 70 is disposed in the lower half of the toner storing portion 40.

Further, the second agitating member 70 is provided adjacent to the toner supply section 51. Accordingly, when the elastic film 75 is separated from the upper surface 50*a* of the partition wall 50, the elastic restoring force generated in the elastic film 75 applies an impact force to the toner positioned above the toner supply section 51 so that the toner in the toner storing portion 40 may be supplied to the developing portion 30.

By minimizing the area in which the second agitating member 70 is in contact with the toner stored in the toner storing portion 40 as described above, the stress applied to the toner by the second agitating member 70 may be minimized. Accordingly, the life of the toner stored in the toner storing portion 40 may be prolonged. Also, since the second agitating member 70 is provided in the lower part of the toner storing portion 40, the toner stored in the toner storing portion 40 may be supplied to the developing portion 30 sequentially from the toner in the lower part adjacent to the toner supply section 51.

Figure 11:
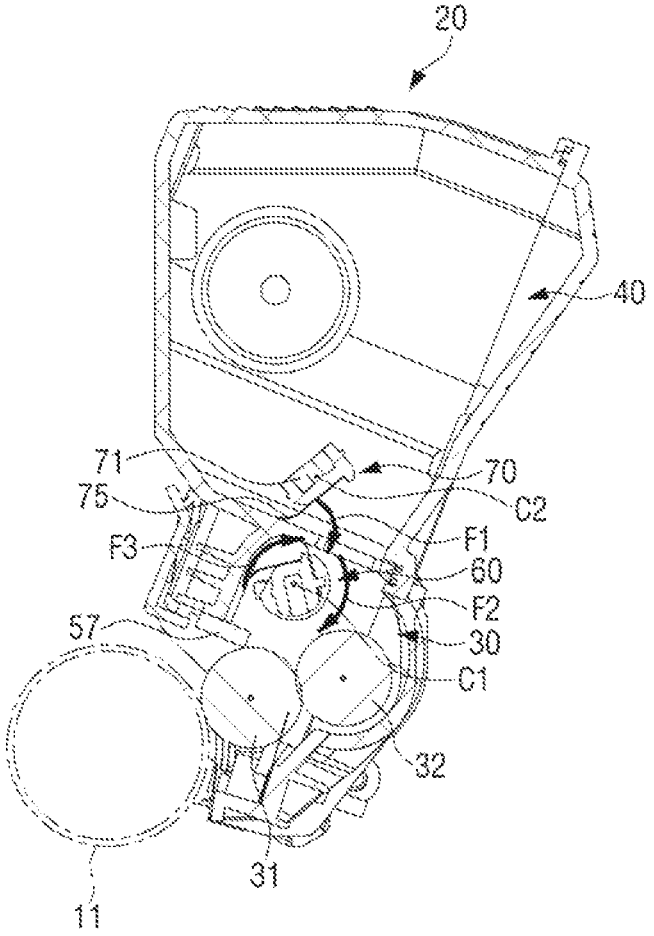
FIG. 11 is a view for explaining movement of toner by rotation of a first agitating member and a second agitating member of a developing cartridge according to an embodiment of the present disclosure.

FIG. 11 is a view for explaining movement of toner by rotation of a first agitating member and a second agitating member of a developing cartridge according to an embodiment of the present disclosure.

In the case in which the first agitating member 60 is provided in the developing portion 30 and the second agitating member 70 is provided in the toner storing portion 40 as described above, when the second agitating member 70 rotates, as illustrated by arrow F1 in FIG. 11, the toner which is positioned in the lower part of the toner storing portion 40 is moved to the developing portion 30 through the toner supply section 51 by the elastic force generated when the elastic film 75 of the second agitating member 70 comes contact with and then is separated from the upper surface 50*a* of the partition wall 50. In addition, when the first agitating member 60 rotates, as illustrated by arrows F2 and F3 in FIG. 11, the toner in the developing portion 30 may be efficiently agitated by the elastic force generated when the elastic film 65 of the first agitating member 60 comes into contact with and is separated from the lower surface 50*b* of the partition wall 50.

The developing cartridge 20 according to an embodiment of the present disclosure as described above may be configured to rotate the developing roller 31, the supply roller 32, the first agitating member 60, and the second agitating member 70 using the driving force transmitted from the outside.

Hereinafter, a power transmission mechanism of the developing cartridge according to an embodiment of the present disclosure will be described in detail with reference to FIGS. 12 to 16.

Figure 12:
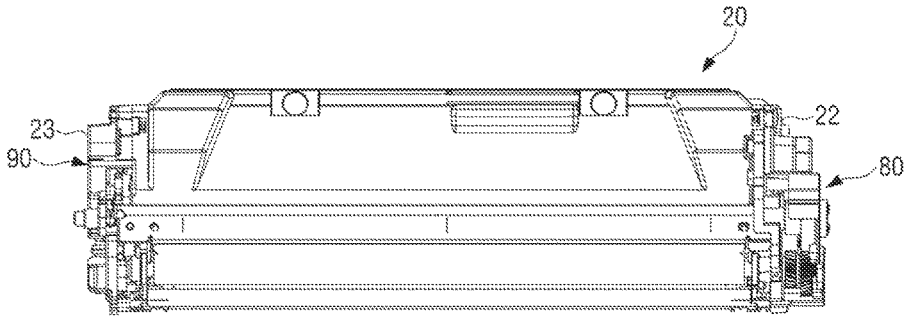
FIG. 12 a front view illustrating a developing cartridge according to an embodiment of the present disclosure.
Figure 13:
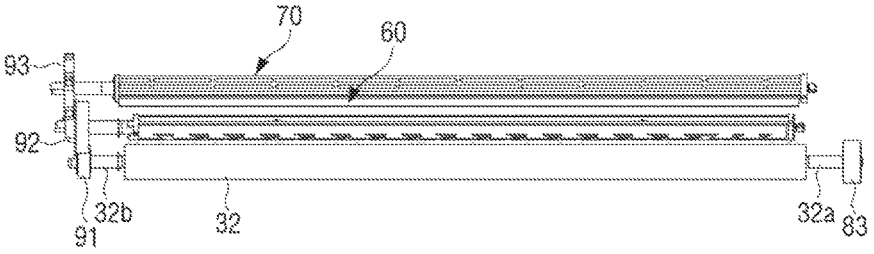
FIG. 13 is a perspective view illustrating a power transmission mechanism of a supply roller, a first agitating member, and a second agitating member of the developing cartridge of FIG. 12.
Figure 14A:
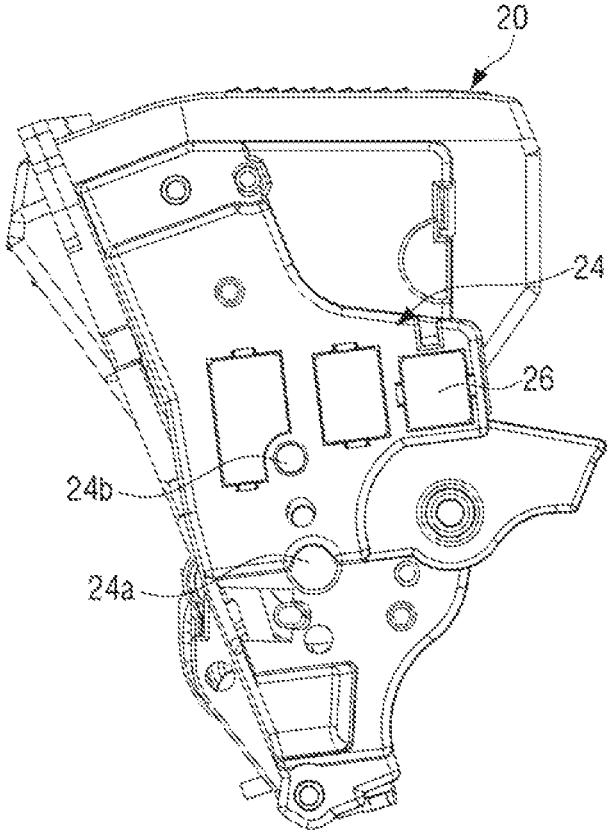
FIG. 14A is a left side view of a developing cartridge according to an embodiment of the present disclosure.
Figure 14B:
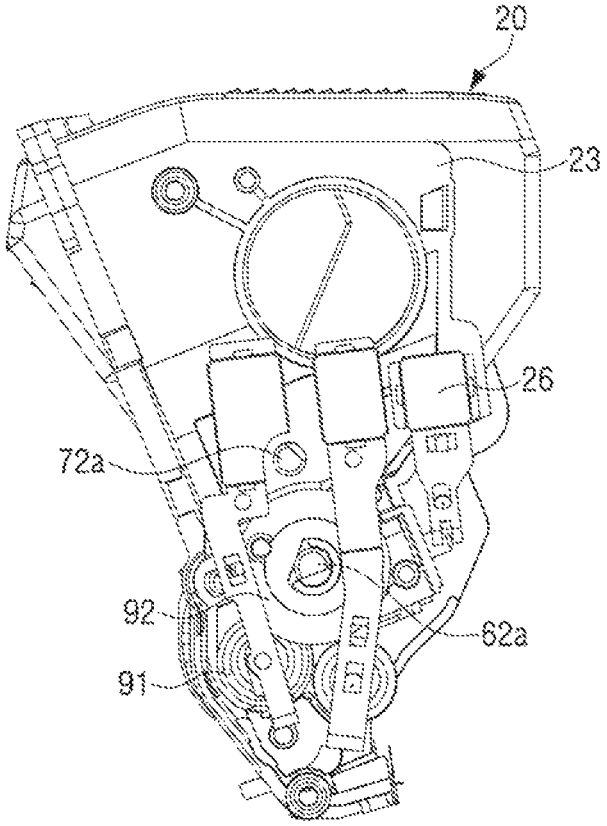
FIG. 14B is a view illustrating a state in which a left side cover is removed from the developing cartridge of FIG. 14A.
Figure 15:
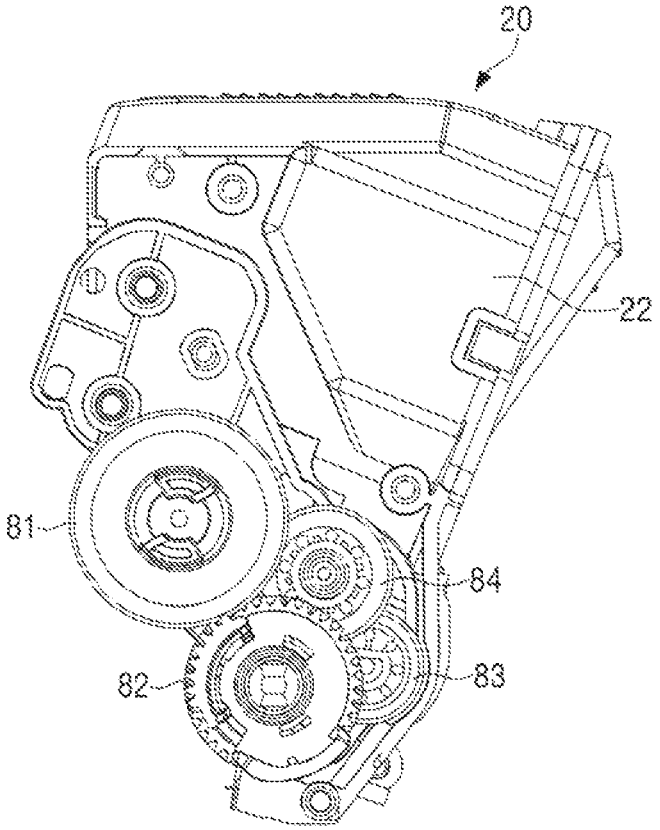
FIG. 15 is a view illustrating a first power transmission mechanism provided on the right side of a developing cartridge according to an embodiment of the present disclosure.
Figure 16:
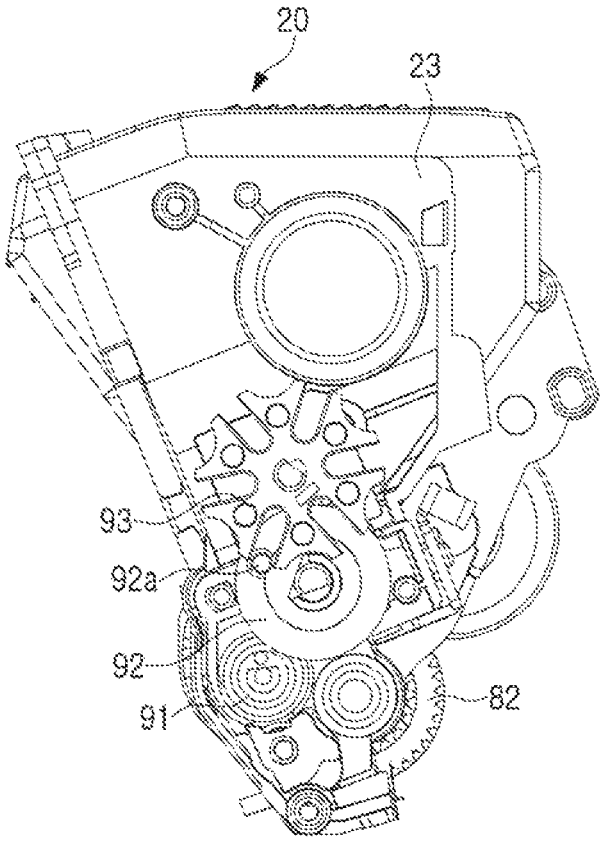
FIG. 16 is a view illustrating a second power transmission mechanism provided on the left side of a developing cartridge according to an embodiment of the present disclosure.

FIG. 12 a front view illustrating a developing cartridge according to an embodiment of the present disclosure. FIG. 13 is a perspective view illustrating a power transmission mechanism of a supply roller, a first agitating member, and a second agitating member of the developing cartridge of FIG. 12. FIG. 14A is a left side view of a developing cartridge according to an embodiment of the present disclosure, and FIG. 14B is a view illustrating a state in which a left side cover is removed from the developing cartridge of FIG. 14A. FIG. 15 is a view illustrating a first power transmission mechanism provided on the right side of a developing cartridge according to an embodiment of the present disclosure. FIG. 16 is a view illustrating a second power transmission mechanism provided on the left side of a developing cartridge according to an embodiment of the present disclosure.

The power transmission mechanism 80 and 90 of the developing cartridge 20 according to an embodiment of the present disclosure may be formed to receive a driving force from the outside and to transmit the driving force to the developing roller 31, the supply roller 32, the first agitating member 60, and the second agitating member 70.

Referring to FIGS. 12 to 16, the power transmission mechanism 80 and 90 may include a first power transmission mechanism 80 that receives the driving force from the outside and rotates the developing roller 31 and the supply roller 32, and a second power transmission mechanism 90 that receives the driving force from the supply roller 32 and rotates the first agitating member 60 and the second agitating member 70. The first power transmission mechanism 80 and the second power transmission mechanism 90 are provided on opposite side surfaces 22 and 23 of the developing cartridge 20. In FIG. 12, the first power transmission mechanism 80 is provided on the right side surface 22 of the developing cartridge 20 and the second power transmission mechanism 90 is provided on the left side surface 23 of the developing cartridge 20.

The first power transmission mechanism 80 may include a cartridge driver 81 that receives the driving force from the outside, a developing roller driver 82 that is provided at a first end of the developing roller 31 and is rotated by the driving force transmitted from the cartridge driver 81, and a first supply roller driver 83 that is provided at a first end of the supply roller 32 and is rotated by the driving force transmitted from the developing roller driver 82.

Figure 23:
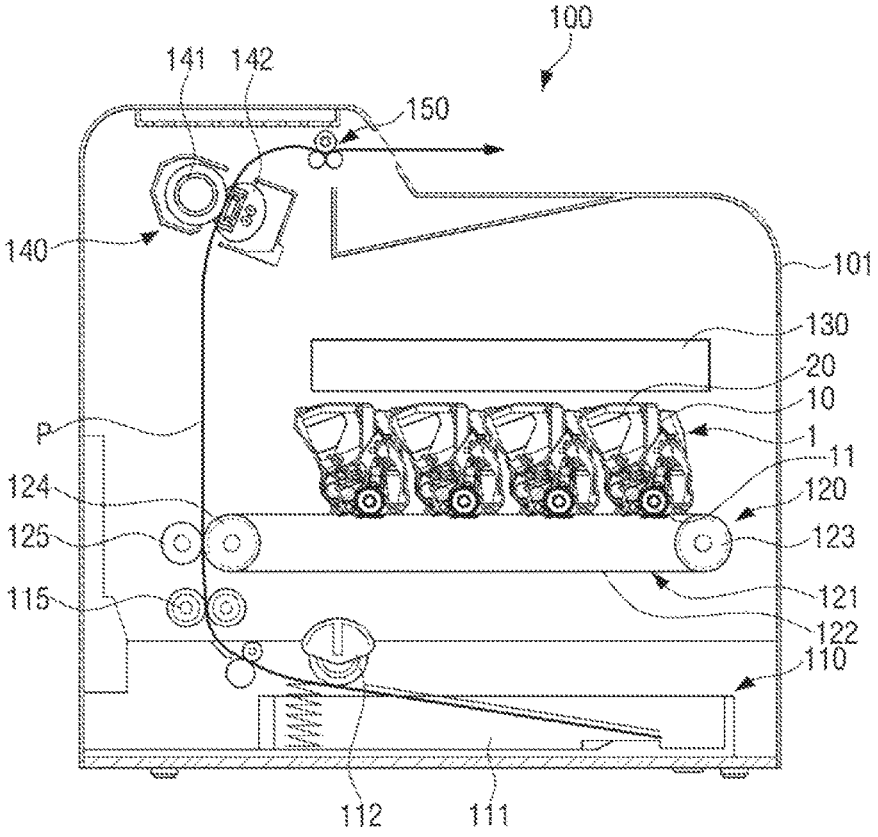
FIG. 23 is a cross-sectional view schematically illustrating an image forming apparatus including a developing apparatus according to an embodiment of the present disclosure.

At this time, the cartridge driver 81 may be realized as a developing coupler and may be configured to receive the driving force from a driving source (not illustrated) provided in a main body 101 of an image forming apparatus 100 (see FIG. 23). The developing roller driver 82 and the first supply roller driver 83 may be formed in a gear. For example, the developing roller driver 82 may be implemented as a developing roller gear, and the first supply roller driver 83 may be implemented as a first supply roller gear. A reduction gear 84 may be provided between the developing roller gear 82 and the first supply roller gear 83, and control the rotational direction and rotation speed of each of the developing roller 31 and the supply roller 32.

The second power transmission mechanism 90 may include a second supply roller driver 91 that is disposed at a second end 32*b* opposite to the first end 32*a* of the supply roller 32, a first agitating member driver 92 that is provided at one end of the first agitating member 60 and rotated by receiving the driving force from the second supply roller driver 91, and a second agitating member driver 93 that is provided at one end of the second agitating member 70 and rotated by receiving the driving force from the first agitating member driver 92. Accordingly, the second supply roller driver 91, the first agitating member driver 92, and the second agitating member driver 93 are positioned on the opposite side surface 23 of the side surface 22 of the developing cartridge 20 in which the cartridge driver 81 and the first supply roller driver 83 are disposed in the longitudinal direction of the developing cartridge 20.

At this time, the second supply roller driver 91 may be formed in a gear. For example, the second supply roller driver 91 may be implemented as a second supply roller gear. The first agitating member driver 92 may be formed in a gear. For example, the first agitating member driver 92 may be implemented as a first agitating member gear.

The second agitating member driver 93 may be implemented as an intermittent motion mechanism. In other words, the second agitating member driver 93 may be configured to rotate intermittently while the first agitating member driver 92 makes one rotation. That is, while the first agitating member driver 92 makes one rotation, the second agitating member driver 93 may be configured to repeat rotation and stop. For example, the second agitating member driver 93 may be implemented as a Geneva gear as illustrated in FIG. 16. In order to drive the Geneva gear 93, a pin 92*a* is provided on one side surface of the first agitating member driver 92. Therefore, when the first agitating member 60 makes one rotation, the second agitating member 70 makes ⅙ rotation. In the developing cartridge 20 according to an embodiment of the present disclosure, since the toner storing portion 40 and the developing portion 30 are arranged in the vertical direction, even though the second agitating member 70 intermittently rotates to supply the toner to the developing portion 30, the toner may be smoothly supplied. Further, when the second agitating member 70 rotates intermittently, the toner stored in the toner storing portion 40 receives less stress, so that a long life developing cartridge may be realized.

In addition, each of the first agitating member driver 92 and the second agitating member driver 93 may be provided to be supported at opposite ends. For example, the first agitating member driver 92 is disposed on the rotational shaft 62 of the first agitating member 60 protruding from the side surface of the developing portion 30, that is, the side surface 23 of the developing cartridge 20, and the end portion 62*a* of the rotational shaft 62 protrudes from the first agitating member driver 92 as illustrated in FIG. 7. The protruded portion 62*a* of the rotational shaft 62 is supported by a first support portion 24*a* provided on an outer cover 24 disposed on one side of the developing cartridge 20. Accordingly, the rotational shaft 62 provided with the first agitating member driver 92 may be supported at both ends by the side surface 23 of the developing cartridge 20 and the outer cover 24.

Further, the second agitating member driver 93 is disposed on the rotational shaft 72 of the second agitating member 70 protruding from the side surface of the toner storing portion 40, that is, the side surface 23 of the developing cartridge 20, and the end portion 72*a* of the rotational shaft 72 protrudes from the second agitating member driver 93 as illustrated in FIG. 8. The protruded portion 72*a* of the rotational shaft 72 is supported by a second support portion 24*b* provided on the outer cover 24 disposed on one side of the developing cartridge 20. Accordingly, the rotational shaft 72 provided with the second agitating member driver 93 may be supported at both ends by the side surface 23 of the developing cartridge 20 and the outer cover 24.

Also, the side surface 23 of the developing cartridge 20 on which the first agitating member driver 92 and the second agitating member driver 93 are disposed is provided with a plurality of electrical contacts 26 for receiving a voltage applied to the developing roller 31 and the supply roller 32. At this time, the end portion 62*a* of the rotational shaft 62 of the first agitating member 60 and the end portion 72*a* of the rotational shaft 72 of the second agitating member 70 are provided to be positioned between the pluralities of electrical contacts 26.

Hereinafter, operation of the developing roller 31, the supply roller 32, the first agitating member 60, and the second agitating member 70 by the power transmission mechanism 80 and 90 having the above-described structure will be described with reference to FIGS. 15 and 16.

When the developing coupler 81 receives a driving force from the driving source (not illustrated) provided inside the image forming apparatus 100 (see FIG. 23), the developing coupler 81 rotates. When the developing coupler 81 rotates, the developing roller gear 82 is rotated, and then the developing roller 31 is rotated. When the developing roller gear 82 rotates, the first supply roller gear 83 is rotated through the reduction gear 84. When the first supply roller gear 83 rotates, the supply roller 32 is rotated and the second supply roller gear 91 provided at the second end of the supply roller 32 is also rotated.

When the second supply roller gear 91 rotates, the first agitating member gear 92 engaged with the second supply roller gear 91 is rotated. When the first agitating member gear 92 rotates, the first agitating member 60 is rotated. Also, when the first agitating member gear 92 rotates, the Geneva gear 93 provided in the second agitating member 70 is intermittently rotated by the pin 92*a* provided on the first agitating member gear 92. Therefore, the second agitating member 70 also intermittently rotates to agitate and supply the toner in the toner storing portion 40.

In the above description, an intermittent driving mechanism such as a Geneva gear is used as the second agitating member driver 93; however, the second agitating member driver 93 is not limited thereto. For example, the second agitating member driver may be implemented as a gear.

Figure 17:
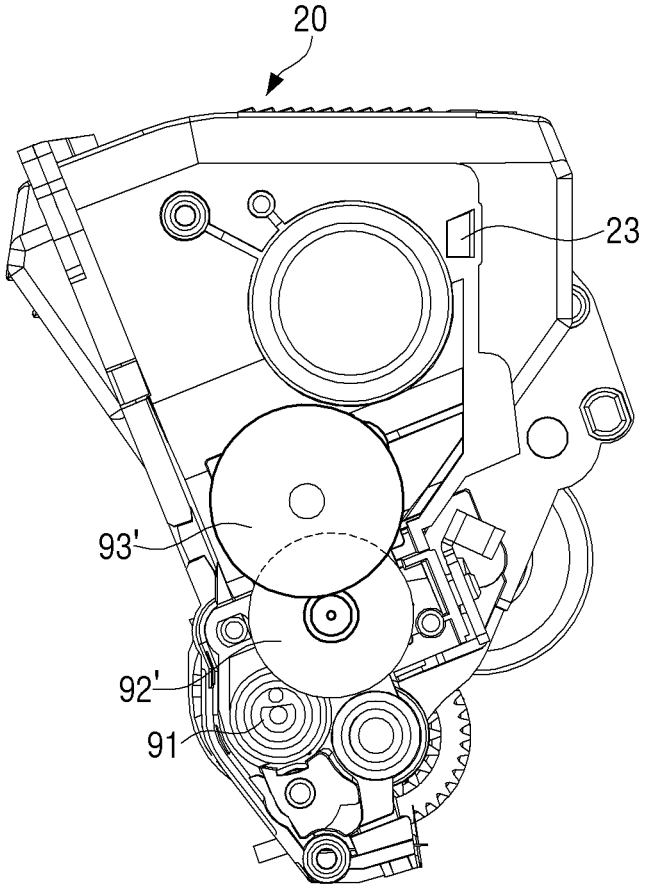
FIG. 17 is a view illustrating another example of a second power transmission mechanism of a developing cartridge according to an embodiment of the present disclosure.

FIG. 17 is a view illustrating another example of a second power transmission mechanism of a developing cartridge according to an embodiment of the present disclosure.

As illustrated in FIG. 17, when the second agitating member driver is implemented by a gear 93', the second agitating member 70 is continuously rotated in the same manner as the first agitating member 60. In this case, it is necessary to reduce the stress that the second agitating member 70 applies to the toner in the toner storing portion 40 by lowering the rotational speed of the second agitating member 70. To this end, the first agitating member gear 92' may be formed in a double gear, and a gear having a small number of gear teeth may be engaged with the second agitating member gear 93'.

When the power transmission mechanism 80 and 90 for driving the developing roller 31, the supply roller 32, the first agitating member 60, and the second agitating member 70 is divided into the first power transmission mechanism 80 and the second power transmission mechanism 90 and provided on the left side surface 22 and the right side surface 23 of the developing cartridge 20, frictional heat generated when driving the developing cartridge 20 may be distributed. Therefore, the developing cartridge 20 according to an embodiment of the present disclosure may lower the frictional heat as compared with the structure in which the power transmission mechanism 80 and 90 for driving the developing roller 31, the supply roller 32, the first agitating member 60, and the second agitating member 70 is entirely provided on one side surface 22 of the developing cartridge 20. If the frictional heat generated in the power transmission mechanism of the developing cartridge 20 is high, thermal deformation may occur in parts made of plastic material constituting the developing cartridge 20, thereby adversely affecting image quality. Further, in the case of using four developing cartridges as in a color image forming apparatus, excessive frictional heat may raise temperature inside the image forming apparatus, thereby deteriorating the performance of the toner stored inside the developing cartridge.

Hereinafter, another example of the first agitating member usable in the developing cartridge according to an embodiment of the present disclosure will be described in detail with reference to FIGS. 18 to 22.

Figure 18:
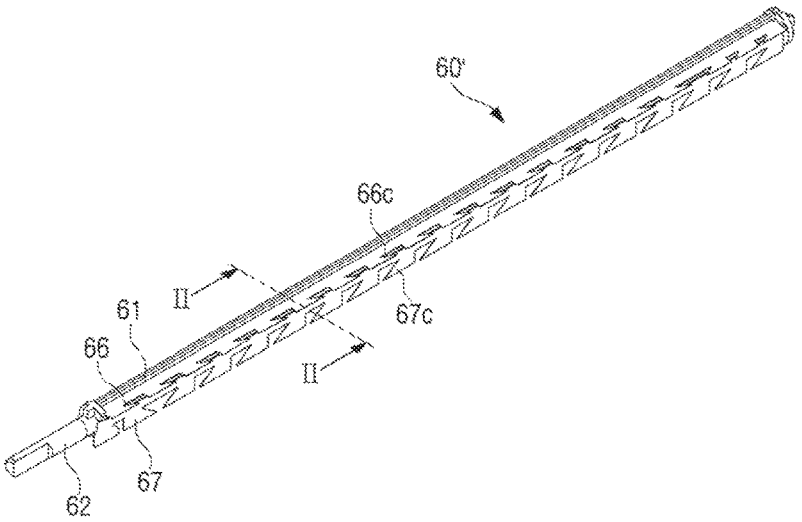
FIG. 18 is a perspective view illustrating another example of a first agitating member used in a developing cartridge according to an embodiment of the present disclosure.
Figure 19:
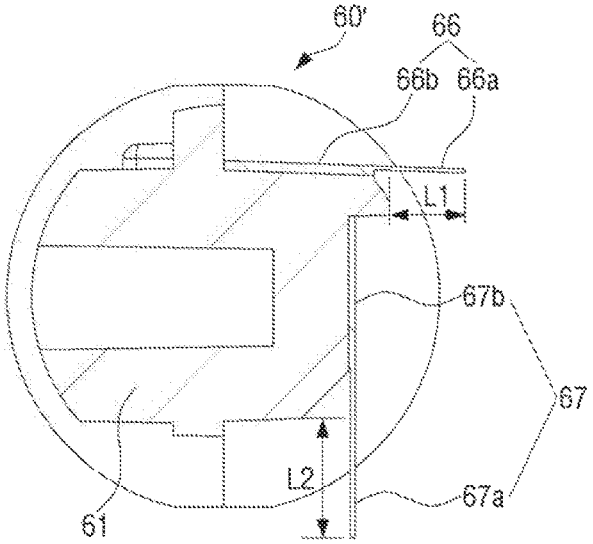
FIG. 19 is a cross-sectional view illustrating the first agitating member of FIG. 18 taken along a line II-II.
Figure 20A:
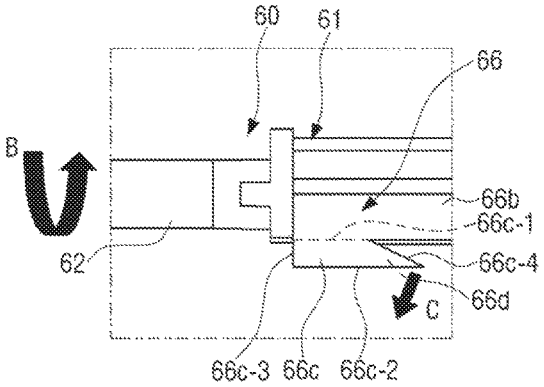
FIG. 20A is a partially enlarged view illustrating a first elastic film of a first agitating member according to an embodiment of the present disclosure.
Figure 20B:
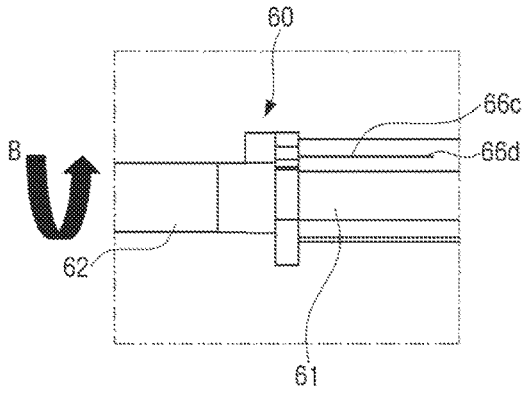
FIG. 20B is a front view illustrating the first elastic film of the first agitating member of FIG. 20A.
Figure 20C:
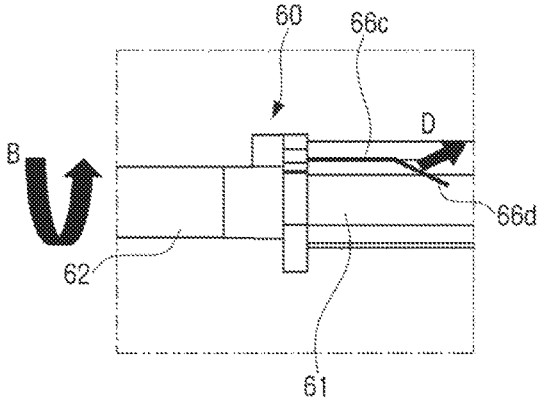
FIG. 20C is a view illustrating a state in which the first elastic film of FIG. 20B is bent by toner.
Figure 21:
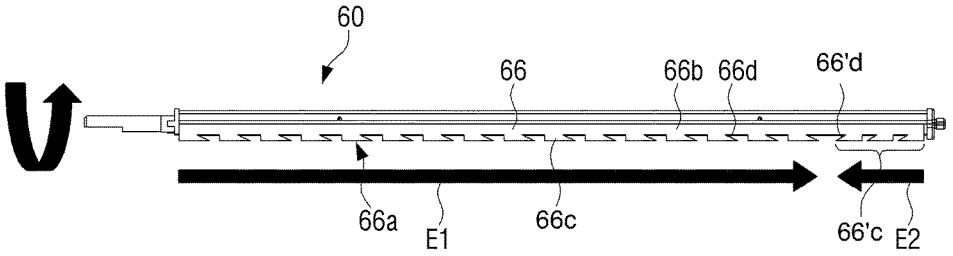
FIG. 21 is a view illustrating a moving direction of toner by the first elastic film of the first agitating member of FIG. 18.
Figure 22:
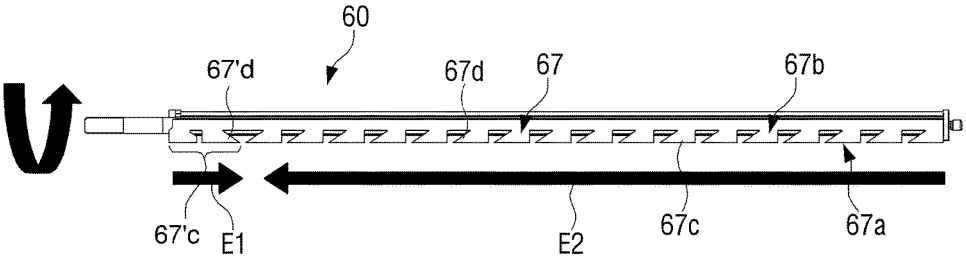
FIG. 22 is a view illustrating a moving direction of toner by a second elastic film of the first agitating member of FIG. 18.

FIG. 18 is a perspective view illustrating another example of a first agitating member used in a developing cartridge according to an embodiment of the present disclosure. FIG. 19 is a cross-sectional view illustrating the first agitating member of FIG. 18 taken along a line II-II. FIG. 20A is a partially enlarged view illustrating a first elastic film of a first agitating member according to an embodiment of the present disclosure, FIG. 20B is a front view illustrating the first elastic film of the first agitating member of FIG. 20A, and FIG. 20C is a view illustrating a state in which the first elastic film of FIG. 20B is bent by toner. FIG. 21 is a view illustrating a moving direction of toner by the first elastic film of the first agitating member of FIG. 18, and FIG. 22 is a view illustrating a moving direction of toner by the second elastic film of the first agitating member of FIG. 18.

Referring to FIGS. 18 and 19, a first agitating member 60' according to an embodiment of the present disclosure may include a rotation member 61 and two elastic films 66 and 67.

The rotation member 61 is formed of a rigid body and rotated by power transmitted from the supply roller 32. At opposite ends of the rotation member 61, a rotational shaft 62 is provided. Accordingly, the rotation member 61 is rotatably supported by both side walls of the developing portion 30.

The two elastic films 66 and 67, that is, a first elastic film 66 and a second elastic member 67 are attached to the rotation member 61. The first elastic film 66 and the second elastic member 67 are provided so that one side portion of each of the first elastic film 66 and the second elastic member 67 protrudes from the rotation member 61. The first elastic film 66 and the second elastic member 67 are provided so that the protruded portions 66*a* and 67*a* form approximately 90 degrees with each other. For example, when the rotation member 61 is formed in a substantially rectangular cross-sectional shape as illustrated in FIG. 19, the first elastic film 66 and the second elastic member 67 may be disposed on two adjacent side surfaces of the rotation member 61. The protruding length L1 of the first elastic film 66 may be determined to be a length in which a portion of the first elastic film 66 is brought into contact with and bent by the lower surface 50*b* of the partition wall 50. The protruding length L2 of the second elastic film 67 may be determined to be a length in which a portion of the second elastic film 67 is brought into contact with and bent by the lower surface 50*b* of the partition wall 50 like the first elastic film 66.

Further, each of the first elastic film 66 and the second elastic member 67 may be formed to move the toner contained in the developing portion 30 in the axial direction or the longitudinal direction of the first agitating member 60. In detail, the first elastic film 66 and the second elastic member 67 may be formed to move the toner in opposite directions with respect to each other.

To this end, the first elastic film 66 is provided with a plurality of protrusions 66*c* at predetermined intervals on the portion 66*a* protruding from the rotation member 61, that is, on one side of the first elastic film 66 in contact with the partition wall 50. Referring to FIGS. 18 and 20A, each of the plurality of protrusions 66*c* is formed in a trapezoidal shape, and a length of an upper side 66*c*-1 connected to the fixed portion 66*b* of the first elastic film 66 is shorter than a length of a lower side 66*c*-2 to be in contact with the partition wall 50. At this time, the trapezoidal shape forming each protrusion 66*c* includes a first side wall 66*c*-3 that is substantially perpendicular to the upper side 66*c*-1 and a second side wall 66*c*-4 that is inclined with respect to the upper side 66*c*-1. Then, a triangular part 66*d* of the second side wall 66*c*-4 of the protrusion 66*c* becomes a free end which is not supported by the fixed portion 66*b*.

Accordingly, as illustrated in FIG. 20A, when the first agitating member 60 rotates in the direction of arrow B, since the triangular part 66*d* of the protrusion 66*c* has less strength sustaining the pressure of the toner, the triangular part 66*d* is bent in a direction perpendicular to the drawing (arrow C). In other words, when the protrusion 66*c* of the first agitating member 60 is not subjected to the force, the triangular part 66*d* of the protrusion 66*c* maintains a horizontal state with the other portion of the protrusion 66*c* as illustrated in FIG. 20B. However, when the first agitating member 60 rotates, the triangular part 66*d* of the protrusion 66*c* is bent by the pressure of the toner as illustrated in FIG. 20C. When the first agitating member 60 continues to rotate in the direction of the arrow B, the bent portion 66*d* of the protrusion 66*c* pushes the toner in the direction of arrow D. Therefore, as illustrated in FIG. 21, the toner is moved in the axial direction (direction of arrow E1) by the plurality of protrusions 66*c* of the first elastic film 66.

Some 66'*c* of the plurality of protrusion 66*c* of the first elastic film 66 may be formed in an opposite shape to the remaining protrusions. For example, as illustrated in FIG. 21, some protrusions 66'*c* positioned at the end of the toner moving direction (arrow E1) by the first agitating member 60, for example, three right protrusions 66'*c* of the first elastic film 66 are formed in an opposite shape to the remaining protrusions 66*c*. In other words, most of the protrusions 66*c* of the first elastic film 66 may be formed so that the triangular part 66*d* of the second side wall 66*c*-4 projects to the right side, but some protrusions 66'*c* may be formed so that the triangular part 66*d* of the second side wall 66*c*-4 projects to the left side. When the protrusions 66'*c* having the opposite shape are formed at the end of the toner moving direction (arrow E1) of the first elastic film 66, the toner is moved in the opposite direction at the end of the first elastic film 66. For example, as illustrated in FIG. 21, the toner which is moved to the right side by the first elastic film 66 is moved in the left direction (arrow E2) at the end of the first elastic film 66.

The second elastic film 67 is provided with a plurality of protrusions 67*c* at predetermined intervals on the portion 67*a* protruding from the rotation member 61, that is, on one side in contact with the partition wall 50 like the first elastic film 66. It is the same as the first elastic film 66 that the plurality of protrusion 67*c* is formed in a trapezoidal shape. In other words, a length of an upper side of the protrusion 67*c* connected to the fixed portion 67*b* of the second elastic film 67 is shorter than a length of a lower side to be in contact with the partition wall 50, a first side wall is substantially perpendicular to the upper side, and a second side wall is inclined with respect to the upper side.

Therefore, a triangular part 67*d* formed by the second side wall is not supported by the fixed portion 67*b* of the second elastic member 67. However, there is a difference in that the triangular part 67*d* formed by the second side wall is formed on the side opposite to the triangular part 66*d* of the first elastic film 66. Accordingly, the direction in which the toner is moved by the second elastic member 67 is opposite to the direction in which the toner is moved by the first elastic film 66.

Further, some 67'*c* of the plurality of protrusion 67*c* of the second elastic film 67 may be formed in an opposite shape to the remaining protrusions. For example, as illustrated in FIG. 22, some protrusions 67'*c* positioned at the end of the toner moving direction (arrow E2) by the second elastic member 67, for example, two left protrusions 67'*c* of the second elastic film 67 are formed in an opposite shape to the remaining protrusions 67*c*. In other words, most of the protrusions 67*c* of the second elastic film 67 may be formed so that the triangular part 67*d* of the second side wall projects to the left side, but some protrusions 67'*c* may be formed so that the triangular part 67'*d* of the second side wall projects to the right side. When the protrusions 67'*c* having the opposite shape are formed at the end of the moving direction (arrow E2) of the toner by the second elastic film 67 as described above, the toner is moved in the opposite direction (arrow E1) at the end of the second elastic film 67. For example, as illustrated in FIG. 22, the toner which is moved to the left side by the second elastic film 67 is moved in the right direction (arrow E1) at the end of the second elastic film 67.

As described above, when the toner is moved in the axial direction by the first agitating member 60, congestion of the toner may be prevented and image defects may be prevented. When the toner subjected to stress by the agitating member is congested, streaking or toner solidification may occur so that image contamination or image defects such as image burring, image density fluctuation, or the like in the longitudinal direction of the print medium may be caused.

In addition, when each of the first elastic film 66 and the second elastic member 67 is provided with protrusions having the opposite shape at the end in the moving direction of the toner as described above, the toner may be prevented from congesting at the ends of the first elastic film 66 and the second elastic member 67. When the toner congests at the ends of the first elastic film 66 and the second elastic member 67, the toner may receive stress and heat so that the characteristics of the toner may be changed, thereby adversely affecting the image quality.

Accordingly, in the case in which the first elastic film 66 and the second elastic member 67 are formed like the first agitating member 60 according to an embodiment of the present disclosure as described above, when the first agitating member 60 rotates, the first elastic film 66 and the second elastic member 67 transfer the toner in the opposite direction to each other, thereby improving the fluidity of the toner and preventing the toner from congesting.

In the above description, the first and second agitating members 60 and 70 including the elastic members 65 and 75 that are intermittently in contact with the partition wall 50 are provided in both the developing portion 30 and the toner storing portion 40 of the developing cartridge 20. However, as another embodiment, the first agitating member 60 including the elastic member 65 that is in contact with the partition wall 50 may be provided only in the developing portion 30, and the second agitating member 70 including the elastic member 75 that is in contact with the partition wall 50 may not be provided in the toner storing portion 40. As another embodiment, the second agitating member 70 including the elastic member 75 that is in contact with the partition wall 50 may be provided only in the toner storing portion 40, and the developing portion 30 may not be provided with the first agitating member 60 including the elastic member 65 that is in contact with the partition wall 50.

Hereinafter, an image forming apparatus including the developing apparatus according to an embodiment of the present disclosure will be described with reference to FIG. 23.

FIG. 23 is a cross-sectional view schematically illustrating an image forming apparatus including a developing cartridge according to an embodiment of the present disclosure.

Referring to FIG. 23, an image forming apparatus 100 according to an embodiment of the present disclosure may include a main body 101, a print medium feeding apparatus 110, a developing apparatus 1, a transferring apparatus 120, a fixing apparatus 140, and a print medium discharging apparatus 150.

The main body 101 forms an outer appearance of the image forming apparatus 100 and receives, fixes, and supports the print medium feeding apparatus 110, the developing apparatus 1, the transferring apparatus 120, an exposure apparatus 130, the fixing apparatus 140, and the print medium discharging apparatus 150 therein.

The print medium feeding apparatus 110 is disposed inside the main body 101 and feeds a print medium P to the transferring apparatus 120. The print medium feeding apparatus 110 may include a paper feed cassette 111 and a pickup roller 112. The paper feed cassette 111 receives a predetermined number of print media. The pickup roller 112 picks up the print medium P loaded in the paper feed cassette 111 one by one and feeds the picked print medium P to the transferring apparatus 120.

A plurality of feed rollers 115 for conveying the print medium P picked up by the pickup roller 112 may be provided between the pickup roller 112 and the transferring apparatus 120.

The exposure apparatus 130 emits a predetermined light corresponding to the print data in accordance with the print command.

The developing apparatus 1 forms a predetermined toner image on an image carrier on which an electrostatic latent image is formed by the light emitted from the exposure apparatus 130 and allows the toner image to be transferred to the print medium P in the transferring apparatus 120. The developing apparatus 1 may include an image carrier cartridge 10 and a developing cartridge 20. The structure and operation of the developing apparatus 1 are described above; therefore, the description thereof is omitted. The image forming apparatus 100 according to the present embodiment may include four developing apparatuses 1 to form a color image.

The transferring apparatus 120 transfers the toner image formed in the developing apparatus 1 to the print medium P and may include an intermediate transfer belt unit 121 and a transfer roller 125.

The intermediate transfer belt unit 121 causes the toner image formed on the image carrier 11 of each of the four developing apparatuses 1 to be superimposed to form a color image. The intermediate transfer belt unit 121 may include an intermediate transfer belt 122 and a drive roller 123 and a driven roller 124 that drive the intermediate transfer belt 122 to perform endless orbital motion.

The transfer roller 125 is provided to be in contact with the intermediate transfer belt 122 and rotate so that the color image formed on the intermediate transfer belt 122 is transferred to the print medium P entering between the transfer roller 125 and the intermediate transfer belt 122.

The fixing apparatus 140 applies heat and pressure to the print medium P having passed through the transfer roller 125 so that the toner image transferred to the print medium P is fixed on the print medium P. The fixing apparatus 140 may include a pressure roller 141 and a heating roller 142 that face each other and rotate.

The print medium discharging apparatus 150 discharges the print medium P, on which the image is fixed while passing through the fixing apparatus 140, to the outside of the image forming apparatus 100. The print medium discharging apparatus 150 may include a pair of discharge rollers that face each other and rotate.

As described above, the developing apparatus 1 according to an embodiment of the present disclosure may form a predetermined toner image on the image carrier 11 and cause the toner image to be transferred onto the print medium P through the transferring apparatus 120.

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the inventive concepts.

What is claimed is:

1. A developing cartridge that is couplable to an image forming apparatus, the developing cartridge comprising:
- a developing portion;
- a toner storing portion to store toner;
- a partition wall formed between the developing portion and the toner storing portion, to block the toner in the toner storing portion from moving to the developing portion, the partition wall having a toner supply section through which the toner in the toner storing portion is supplied to the developing portion;
- a first agitating member rotatably disposed in the developing portion; and
- a second agitating member rotatably disposed in the toner storing portion,
  - wherein at least one of the first agitating member or the second agitating member includes an elastic member to be in contact with the partition wall formed to block the toner.

2. The developing cartridge of claim 1, wherein,
- when the second agitating member including the elastic member rotates, the elastic member of the second agitating member is to be intermittently in contact with the partition wall and is not in contact with an inner surface of the toner storing portion.

3. The developing cartridge of claim 2, wherein
- the second agitating member includes a rotation member, and
- the elastic member includes an elastic film attached to the rotation member,
  - wherein the elastic film is to be in contact with an upper surface of the partition wall and moves toner toward the toner supply section by an elastic restoring force generated when the elastic film is separated from the upper surface of the partition wall.

4. The developing cartridge of claim 1, wherein
- the first agitating member is disposed below the partition wall, and a rotation center of the first agitating member is spaced apart from vertical extension lines of opposite ends of the toner supply section.

5. The developing cartridge of claim 4, wherein,
- the first agitating member includes the elastic member,
- the first agitating member includes a rotation member, and
- the elastic member includes at least one elastic film attached to the rotation member, and
  - wherein the at least one elastic film is in contact with a lower surface of the partition wall when the first agitating member rotates.

6. The developing cartridge of claim 5, wherein
- the at least one elastic film of the first agitating member includes a first elastic film and a second elastic film that are disposed at an interval of about 90 degrees on the rotation member.

7. The developing cartridge of claim 6, wherein the first elastic film and the second elastic film are formed to move toner in mutually opposite directions.

8. The developing cartridge of claim 6, wherein each elastic film of the first elastic film and the second elastic film includes a plurality of protrusions formed at intervals on one side to move toward the partition wall, and wherein each protrusion of the plurality of protrusions is formed in a trapezoidal shape, in which a length of a first side of each protrusion connected to the first elastic film or the second elastic film is shorter than a length of a second side of each protrusion that is to be in contact with the partition wall.

9. The developing cartridge of claim 8, wherein each of the plurality of protrusions includes a first side wall perpendicular to the first side and a second side wall inclined with respect to the first side, and wherein a direction of the second side wall of each of the plurality of protrusions of the first elastic film is opposite to a direction of the second side wall of each of the plurality of protrusions of the second elastic film.

10. The developing cartridge of claim 1, further comprising:

a developing roller rotatably disposed in the developing portion; and a supply roller disposed at one side of the developing roller, the supply roller to supply toner supplied from the toner storing portion to the developing roller, wherein a rotation center of the first agitating member is positioned between a rotation center of the developing roller and a rotation center of the supply roller.

11. The developing cartridge of claim 10, further comprising:

a cartridge driver in one side surface of the developing cartridge and to receive power from an outside of the cartridge driver;

a first supply roller driver at a first end of the supply roller and to be rotated by a driving force transmitted from the cartridge driver;

a second supply roller driver at a second end opposite to the first end of the supply roller;

a first agitating member driver at one end of the first agitating member and to receive the driving force from the second supply roller driver; and a second agitating member driver at one end of the second agitating member and to receive the driving force from the first agitating member driver, wherein the second supply roller driver, the first agitating member driver, and the second agitating member driver are positioned on an opposite side surface opposite to a side surface of the developing cartridge with respect to a longitudinal direction of the developing cartridge.

12. The developing cartridge of claim 11, wherein the second agitating member driver is to repeat rotating and stopping while the first agitating member driver rotates.

13. The developing cartridge of claim 11, wherein the second agitating member driver includes a Geneva gear.

14. The developing cartridge of claim 11, comprising a plurality of electrical contacts on the opposite side surface of the developing cartridge, to receive a voltage applied to the developing roller and the supply roller.

15. The developing cartridge of claim 1, further comprising:

a blade supporting wall extending downward from a lower surface of the partition wall, wherein, when the first agitating member including the elastic member and rotates, the elastic member of the first agitating member is to be in contact with the blade supporting wall and the lower surface of the partition wall.

16. A developing cartridge comprising:

a developing portion in which a developing roller is rotatably disposed;

a toner storing portion which is disposed above the developing portion and is to store toner;

a partition wall which is formed between the developing portion and the toner storing portion and is provided with a toner supply section through which the toner moves from the toner storing portion to the developing portion;

a first agitating member which is rotatably disposed inside the developing portion and agitates the toner supplied to the developing portion; and a second agitating member which is rotatably disposed inside the toner storing portion and agitates the toner stored in the toner storing portion, wherein the first agitating member is disposed below the partition wall, and a rotation center of the first agitating member is spaced apart from vertical extension lines of opposite ends of the toner supply section.

17. The developing cartridge of claim 16, wherein the first agitating member includes a rotation member and an elastic member attached to the rotation member, and wherein when the first agitating member rotates, the elastic member is intermittently in contact with a lower surface of the partition wall.

18. The developing cartridge of claim 16, wherein the second agitating member includes a rotation member and an elastic member attached to the rotation member, and wherein when the second agitating member rotates, the elastic member is intermittently in contact with an upper surface of the partition wall and is not in contact with an inner surface of the toner storing portion.

19. A developing apparatus comprising:

an image carrier cartridge including an image carrier; and a developing cartridge to supply toner to the image carrier, wherein the developing cartridge comprises:

a developing portion;

a toner storing portion to store toner;

a partition wall formed between the developing portion and the toner storing portion and provided with a toner supply section through which the toner in the toner storing portion is supplied to the developing portion;

a first agitating member rotatably disposed in the developing portion; and a second agitating member rotatably disposed in the toner storing portion, wherein at least one of the first agitating member or the second agitating member includes an elastic member to be in contact with the partition wall formed.

20. An image forming apparatus comprising:

a print medium feeding apparatus to feed a print medium;

a developing apparatus to form a toner image of an image carrier;

a transferring apparatus to transfer the toner image onto the print medium;

a fixing apparatus to fix the toner image onto the print medium; and a print medium discharging apparatus to discharge the print medium, wherein the developing apparatus comprises:

an image carrier cartridge including the image carrier; and a developing cartridge to supply toner to the image carrier, wherein the developing cartridge comprises, a developing portion;

a toner storing portion to store toner;

a partition wall formed between the developing portion and the toner storing portion and provided with a toner supply section through which the toner in the toner storing portion is supplied to the developing portion;

a first agitating member rotatably disposed in the developing portion; and a second agitating member rotatably disposed in the toner storing portion, wherein at least one of the first agitating member or the second agitating member includes an elastic member to be in contact with the partition wall formed.

* * * * *